US005454734A

United States Patent [19]

Eggert et al.

[11] Patent Number: 5,454,734

[45] Date of Patent: Oct. 3, 1995

[54] ELECTRICAL CONNECTION SYSTEM

[75] Inventors: Uwe Eggert, Winnenden; Manfred Illg, Weinstadt, both of Germany

[73] Assignee: ITT Industries, Inc., New York, N.Y.

[21] Appl. No.: 214,736

[22] Filed: Mar. 17, 1994

[30] Foreign Application Priority Data

Mar. 22, 1993 [DE] Germany ..... 43 09 155.5

[51] Int. Cl.[6] ..... H01R 9/07

[52] U.S. Cl. ..... 439/578; 439/581; 439/660

[58] Field of Search ..... 439/578–585, 439/607, 675, 660, 692, 695, 701

[56] References Cited

U.S. PATENT DOCUMENTS

| | | | |
|---|---|---|---|
| 3,078,436 | 2/1963 | Berry | 339/143 |
| 4,094,574 | 6/1978 | Gunn | 339/177 |
| 4,340,265 | 7/1982 | Ott et al. | 339/14 |
| 4,846,711 | 7/1989 | Kobler et al. | 439/63 |
| 4,990,104 | 2/1991 | Schieferly | 439/578 |
| 4,990,105 | 2/1991 | Karlovich | 439/578 |
| 5,055,068 | 10/1991 | Machura et al. | 439/581 |
| 5,102,353 | 4/1992 | Brunker et al. | 439/608 |
| 5,125,854 | 6/1992 | Bassler et al. | 439/607 |
| 5,190,461 | 3/1993 | Oorui et al. | 439/63 |
| 5,238,413 | 8/1993 | McCaffrey et al. | 439/79 |
| 5,334,055 | 8/1991 | Sato et al. | 439/578 |

FOREIGN PATENT DOCUMENTS

| | | |
|---|---|---|
| 0394745 | 4/1990 | European Pat. Off. . |
| 2243034 | 10/1991 | United Kingdom . |

*Primary Examiner*—David L. Pirlot
*Attorney, Agent, or Firm*—Freilich Hornbaker Rosen

[57] ABSTRACT

A connection apparatus for a mobile telephone, includes a plug (2) and a receptacle (1) that each has both beam contacts and coaxial contacts. The plug includes a receiver (10) with a cavity (46) and with a sheath (50) lying within the cavity, and with a gap (22) between them. The receptacle includes a casing (17) that fits into the gap and that receives the sheath of the plug. The plug sheath includes an elongated bridge (9) from which beam contacts (8) project that mate with beam contacts (4) of the receptacle casing. The sheath also includes a coax sheath part (14) that is contiguous with the bridge and that forms a hole (15) that receives a coaxial contact (11) that mates with a coaxial contact (6) in the receptacle casing.

5 Claims, 5 Drawing Sheets

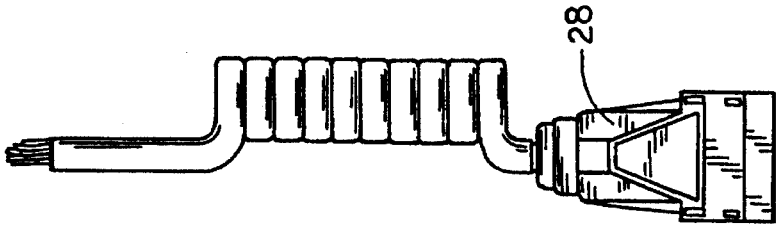
FIG. 10
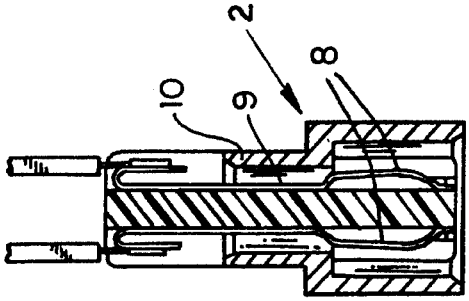
FIG. 9
FIG. 7
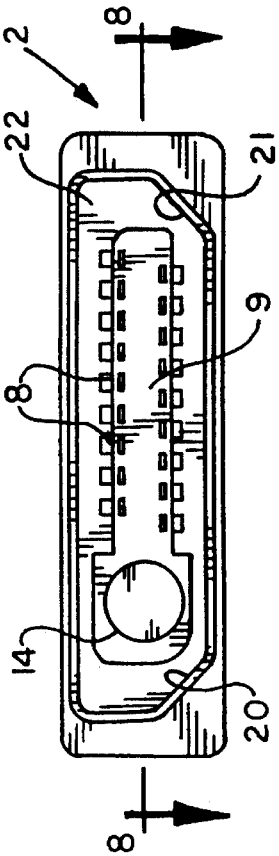
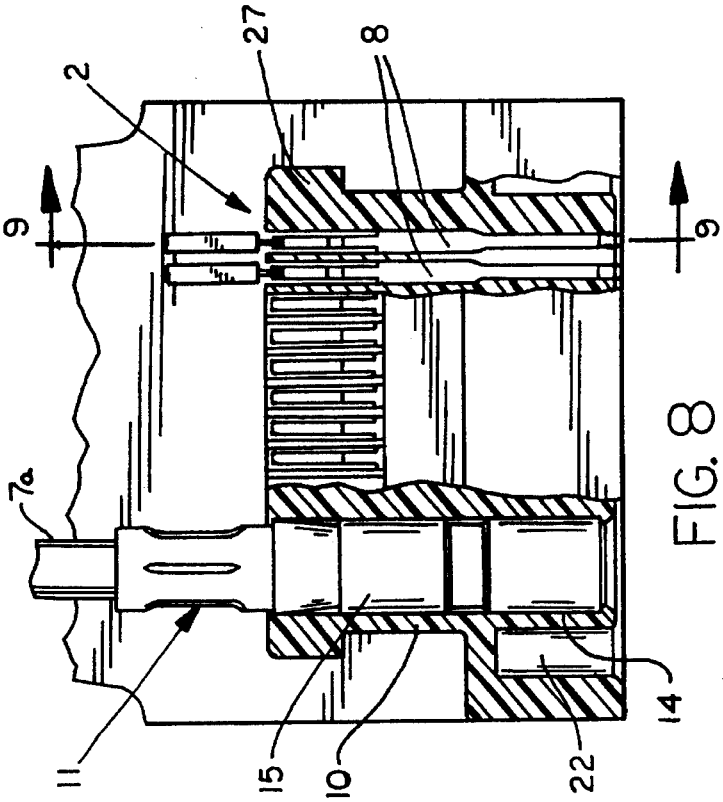
FIG. 8

ELECTRICAL CONNECTION SYSTEM

BACKGROUND OF THE INVENTION

Mobile telephone systems may include a receptacle that receives a plug that connects through a cables to a transceiver. The plug may include a bridge part that plugs into a cavity of the receptacle casing, so that beam contacts on the bridge and in the casing mate. An electrical connection apparatus of this type is described in German Patent Publication DE-OS 25 25 639. If the connection is to be used with a mobile telephone, then a coaxial connection is required to carry high frequency signals. Since the telephone is mobile, it is desirable that the connection apparatus be as compact and light weight as possible, while still being rugged to withstand shocks applied to mobile devices.

SUMMARY OF THE INVENTION

In accordance with one embodiment of the present invention, a connection apparatus comprising a plug and receptacle is provided, which includes both simple and coaxial connections in a rugged miniature design. The plug includes a molded plastic housing that comprises a receiver (10) with a cavity and a sheath (50) lying within the cavity, to leave a gap (22) between them that faces in a mating direction. The receptacle includes a molded plastic housing that comprises a casing (17) with a casing cavity. The casing of the receptacle is receivable in the gap (22) of the plug, with the sheath of the plug received in the casing cavity of the receptacle. A plurality of beam contacts are mounted on a bridge part (9) of the plug sheath, and a coaxial contact (11) is mounted on a coax part of the sheath, with the bridge and coax parts (9, 14) being contiguous with each other and with the rest of the plug housing. The casing (17) of the receiver includes a bridge-receiving part (44) that receives the bridge and that carries a second plurality of beam contacts that mate with the beam contacts on the bridge. The casing also includes a coax casing part (13) that receives the coax part of the sheath and that carries a coax contact (6) that mates with the coax contact on the sheath. The provision of housing portions that hold beam contacts and a coaxial contact so they lie adjacent and contiguous, results in the plug and receptacle connectors each being of small size and being rugged.

The casing (17) has opposite ends and opposite sides, with corner regions at opposite ends of one side having surfaces (18, 19) that are inclined. The casing cavity is similarly constructed with inclined corner regions, to thereby provide a keying arrangement that assures that the plug and receptacle will be mated in the proper relative orientations, with the keying arrangement being rugged and molded in with the rest of the plastic molded housings.

The coax contacts can be provided with tails (37, 72, FIG. 11) that press against conductive pads on a circuit board to make direct contact therewith.

The novel features of the invention are set forth with particularity in the appended claims. The invention will be best understood from the following description when read in conjunction with the accompanying drawings.

BRIEF DESCRIPTION OF THE DRAWINGS

FIG. 7 is a front elevation view of the front of the plug of FIG. 1B.

FIG. 8 is a sectional view taken on line VIII—VIII of FIG. 7.

FIG. 9 is a sectional view taken on line IX—IX of FIG. 8.

FIG. 10 is a side elevation view of a cable with the plug of FIG. 9 mounted thereon.

DESCRIPTION OF THE PREFERRED EMBODIMENTS

Figure 1A:
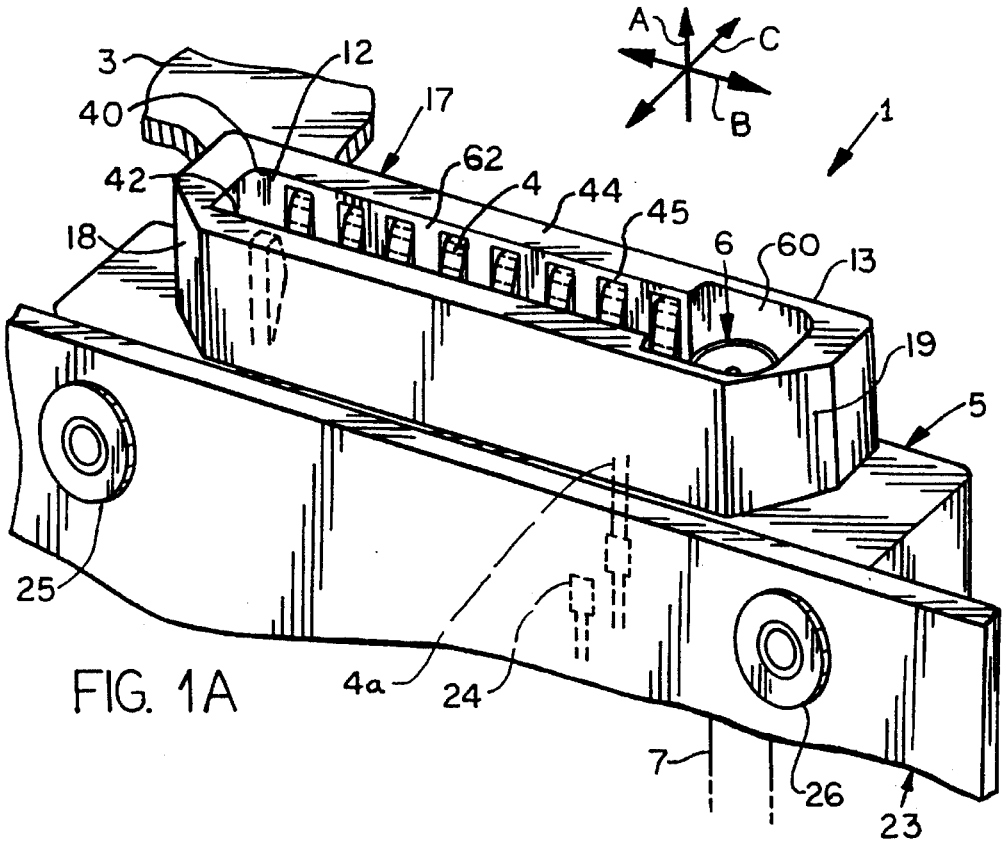
FIG. 1A is an isometric view of a receptacle constructed in accordance with one embodiment of the invention.

FIG. 1A shows a receptacle connector or receptacle 1 which is designed to mount on a frame 3 of an electronic device such as the transceiver of a vehicle mobile phone. The receptacle 1 includes a receptacle housing 5 with a casing 17 that extends in a 360° loop and that has a casing cavity 12 opening in a receiver mating direction A. The receptacle includes beam contacts 4 and a coaxial contact 6. The beam contacts 4 are arranged in two longitudinally-extending rows on laterally opposite sides 40, 42 of the casing cavity, while the coaxial contact 6 is positioned at one end of the cavity. The beam contacts 4 have beams that project from receptacle beam apertures 45. The beam contacts carry lower frequency signals while the coaxial contact 6 is designed to carry high frequency signals such as may be received from an antenna. The receptacle 1 is mounted on a printed circuit board 23, as by rivets 25, 26. Tails **4*a* of the contacts extend to conductive pads 24 on the circuit board. The casing 17 includes a bridge-receiving part 44 where the beam contacts 4 are located, and a contiguous coax casing part 13 where the coaxial contact 6 is located. The coaxial contact is connected to a coaxial cable 7**.

Figure 1B:
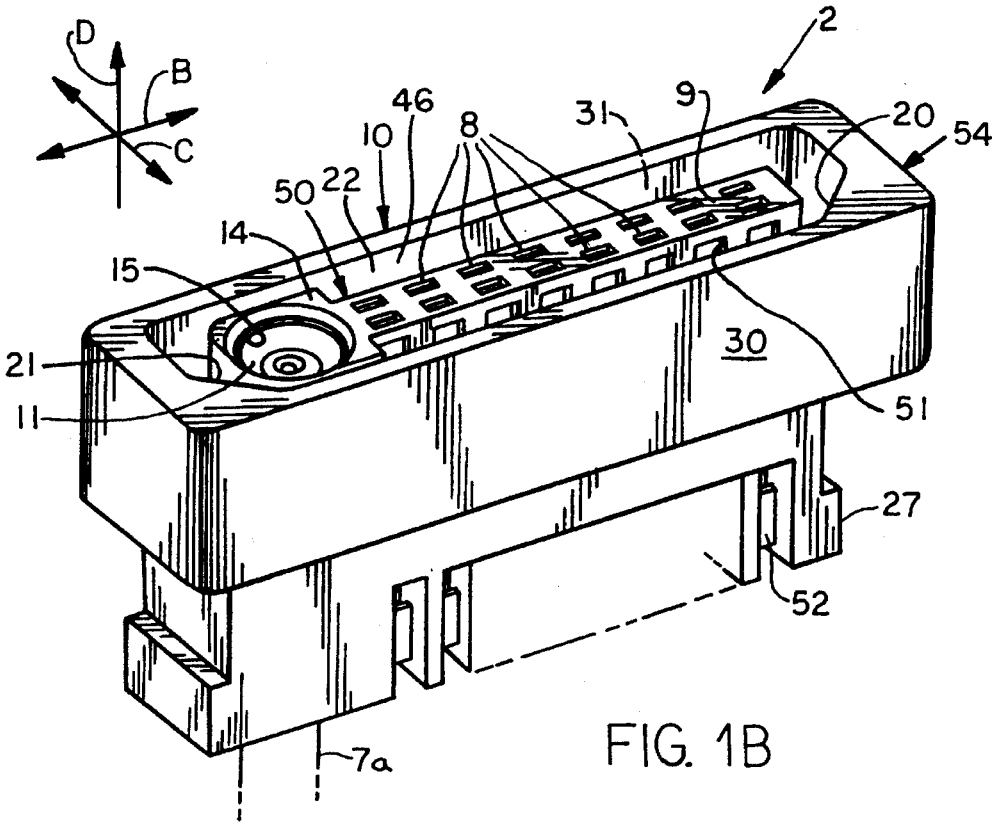
FIG. 1B is an isometric view of a plug which is mateable with the receptacle of FIG. 1A.

FIG. 1B illustrates a plug connector or plug 2 which mates with the receptacle 1. The plug 2 includes a receiver 10 with a cavity 46 that opens in a plug mating direction D. A sheath 50 lies within the cavity, with a gap 22 between the receiver and sheath. Both the receiver and sheath are elongated in the longitudinal direction B and are shorter in the lateral direction C. The sheath 50 includes an elongated bridge part or bridge 9, with beam contact elements or contacts 8 being mounted on the bridge and having beam parts projecting from apertures 51. The sheath also includes a coaxial sheath part 14 that forms a hole 15 of approximately equal width and length (in directions B and C), which receives a coaxial contact 11. The contacts 8 have tails 52 that are designed to connect to ends of a cable such as a flat flexible cable. The coaxial contact 11 connects to a coaxial cable 7*a*.

The plug 2 and receptacle 1 are mated by orienting the plug 2 so that inclined surfaces 20, 21 are aligned with inclined surfaces 18, 19 on the receptacle. Movement of the plug in the mating direction B moves the sheath 50 of the plug into the casing cavity 12 of the receptacle. The beam contacts 8 of the plug project into the gap 22 while the beam contacts 4 of the receptacle project into the casing cavity 12, to assure that the beam contacts will mate. Similarly, inner and outer conductors of the coaxial contacts 6, 11 mate when the plug and receptacle are brought together.

The plug 2 includes a housing 54 which is formed of plastic with all parts molded in a single molding operation so they are integral. After the housing 54 is formed, the beam contacts 8 and coaxial contact 11 are installed. Both the bridge 9 that holds the beam contacts, and the coaxial sheath part 14 that holds the coaxial contact 11, are integrally molded and contiguous, with the part 14 lying at a longitudinal end of the bridge 9. This construction allows the coaxial part 14 to be supported on and to, in turn, support the bridge 9, to strengthen both parts while placing them close together for miniaturization of the plug. The receptacle 1 is similarly constructed, with the bridge receptacle part 44 being integral and contiguous with the coaxial casing part 13. It is noted that the cavity portion 60 in the coaxial casing part 13 has a greater width in the lateral direction C than the cavity portion 62 in the bridge-receiving apart 44. Similarly, for the plug the coaxial sheath part 14 is wider in the lateral direction C than is the bridge 9, although coaxial and bridge or bridge-receiving parts are contiguous (merge) and integrally molded.

The inclined surfaces 18, 19 on the receptacle and 20, 21 on the plug serve as keys to assure that the plug and receptacle are in their proper orientation when mated. The incline surfaces provide relatively large keys that are integrally molded with the rest of the plastic housings 5, 54. Although they are formed of plastic, they are of relatively large size with respect to the rest of the connectors, which allows them to reliably prevent mating in a improper orientation, in a connecting system of small size.

The plug housing 54 has laterally spaced opposite side surfaces 30, 31. The surfaces and the rest of the outside of the housing 54 can be of metal and electrically grounded to protect against electromagnetic interference. The plug housing has a T-shape projection 27 to securely hold it to a cable assembly whose wires connect to the contacts.

Figure 3:
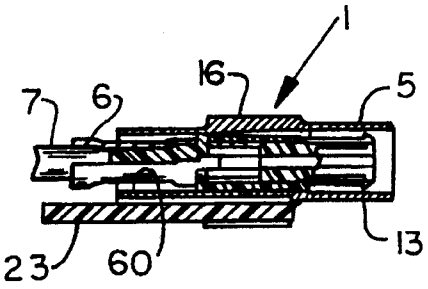
FIG. 3 is a sectional view taken on the line III—III of FIG. 2.
Figure 2:
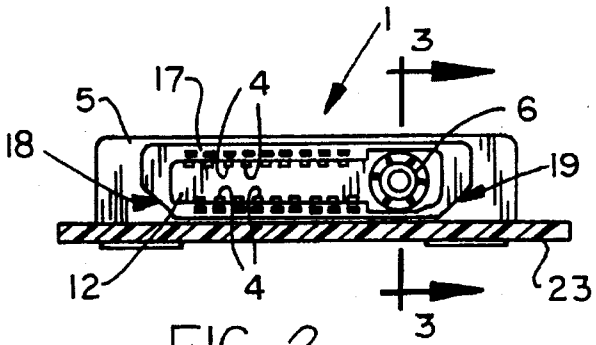
FIG. 2 is a front view of the receptacle of FIG. 1.
Figure 1:
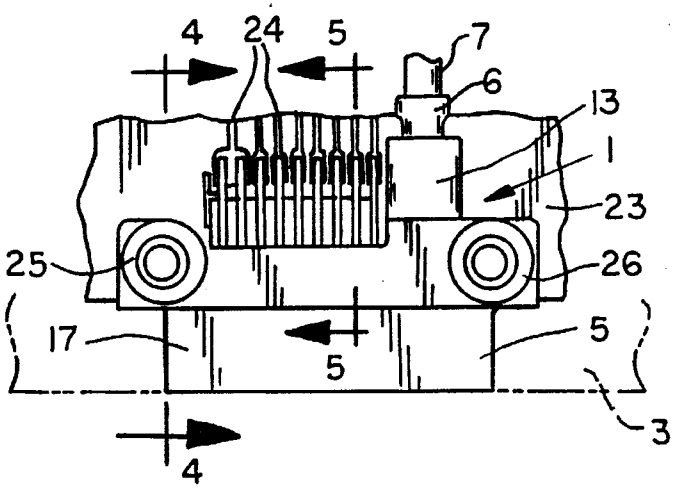
FIG. 1 is a plan view of the receptacle of FIG. 1A.
Figure 5:
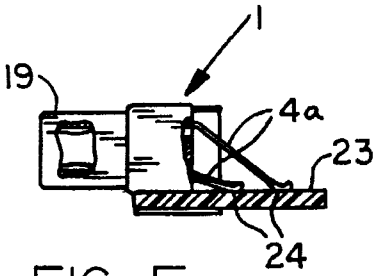
FIG. 5 is a partial sectional view taken on the line V—V of FIG. 1.
Figure 4:
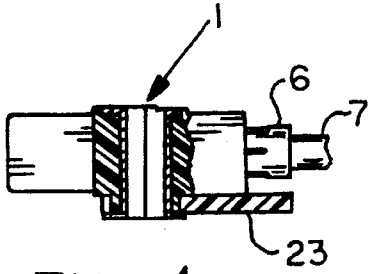
FIG. 4 is a partial sectional view taken on the line IV—IV of FIG. 1.
Figure 6:
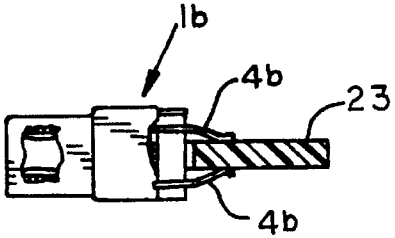
FIG. 6 is a partially sectional side view of a receptacle and circuit board constructed in accordance with another embodiment of the invention.

FIG. 6 shows an arrangement similar to that of FIG. 5, but wherein the contact tails 4*b* are connected to pads on opposite surfaces of the circuit board 23. It also may be noted that the coaxial contact 6 (FIG. 3) can be held in the cavity part 60 by a central area 16 of the coaxial contact that is pressfit or which snaps into place.

Figure 11:
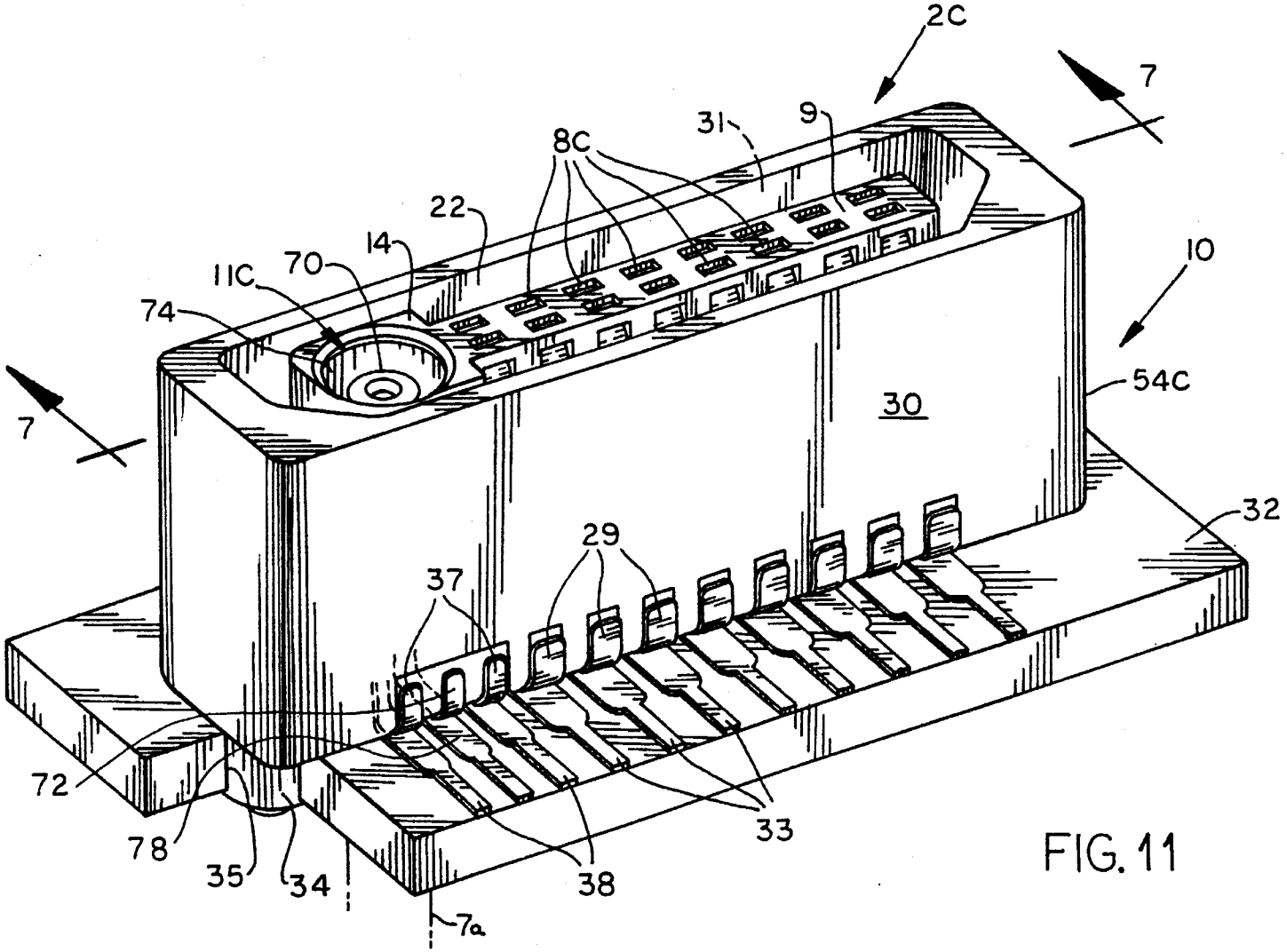
FIG. 11 is an isometric view of a plug constructed in accordance with another embodiment of the invention.
Figure 13:
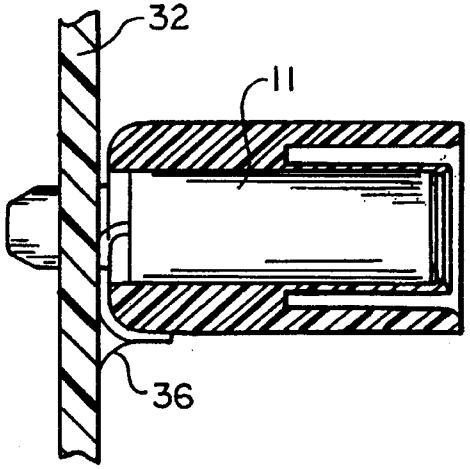
FIG. 13 is a sectional view taken on line XIII—XIII of FIG. 12.
Figure 12:
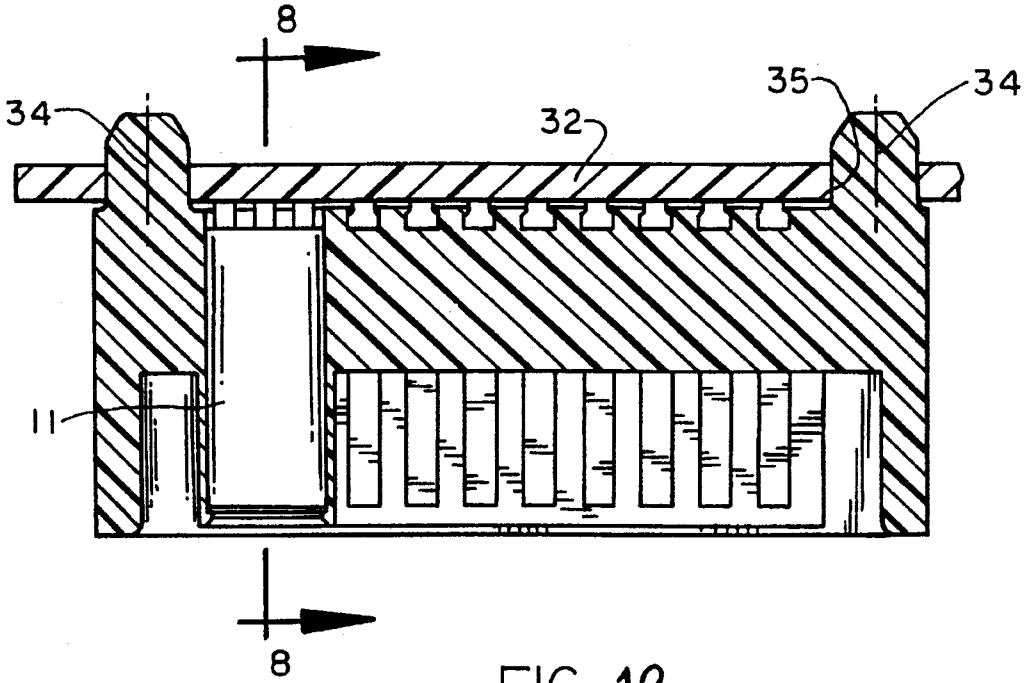
FIG. 12 is a sectional view taken on line XII—XII of FIG. 11.

FIG. 11 illustrates a modified plug connector 2C whose mating portion is similar to that of the plug of 1B, but whose rearward portion is different. The plug 2C lies on a circuit board 32 which has low frequency conductive traces 33 and higher frequency conductive traces 38, 78. The beam contacts 8C have tails 29 which are bent by more than 90° into a largely 180° U-shape and which rest and are solder joined to the low frequency conductive traces 33. The coaxial contact 11C includes a central conductor 70 with a rear portion bent into a tab forming the centermost tail 72 of three tails. The outside coaxial conductor 74 is formed with two U-shaped tabs 37. The center tab 72 is connected to the center trace 78 on the circuit board, while the outer tabs 37 are connected to the outer conductive traces 38. The center tab 78 is therefore surrounded on opposite sides by the grounded outer traces 38, which serve to reduce interference and losses. It can be seen that the housing 54C of the plug 2C is mounted by pins 34 which are preferably integrally molded of plastic with the rest of the housing, and which are received in interference fit in board holes 35 in the circuit board 32.

Thus, the invention provides a connection apparatus comprising a plug and receptacle that can mate, which have both low frequency beam contacts and high frequency coaxial contacts, which are rugged, light weight, and of small size. The plug includes a receiver with a cavity and a sheath within the cavity, which leaves a gap between the receiver and sheath. The receptacle includes a casing that is received in the gap. The sheath includes at least one and preferably two rows of beam contacts. It includes at least one coaxial contact at the end of the row, with beam and coaxial sheath parts of the sheath being integral and contiguous to support one another. The plug and connector each have inclined surfaces at opposite ends of one elongated side, to serve as an integrally molded plastic keys that assures proper mating of the connectors.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A connection apparatus comprising:

a plug and a receptacle, each having beam contacts and at least one coaxial contact;

said plug having a receiver with a cavity and having a sheath lying within said cavity, with a gap between said receiver and said sheath;

said receptacle including a casing with a casing cavity, said casing being insertable into said receiver to lie in said gap while said sheath is received in said casing cavity;

said sheath of said plug including a bridge, with a first plurality of said beam contacts mounted on said bridge, and said sheath including a coax sheath part that forms a hole with a first of said coax contact mounted in said hole, with said bridge and said coaxial sheath part being integrally formed of insulative material;

said casing of said receptacle including a bridge-receiving part that can receive said bridge, with a second plurality of said beam contacts mounted on said bridge-receiving part, and said casing including a coax casing part that can receive said coax sheath part, with a second of said coax contacts mounted in said coax casing part and being mateable with said first coax contact.

2. The apparatus described in claim 1 wherein:

said bridge has a length and width, with said length being greater than said width, and said bridge has opposite ends spaced by said length;

said coax sheath part has a shorter length but greater width than said bridge, and is contiguous with one of said bridge ends.

3. The apparatus described in claim 1 wherein:

said plug and receptacle respectively form a plug and receptacle connector; and including a circuit board attached to one of said connectors, said board having at least one row of conductive pads;

one of said plurality of beam contacts has tail ends that are bent in a loop of at least about 180° and that press against and are joined to said pads.

4. The apparatus described in claim 1 wherein:

said plug and receptacle respectively form a plug connector and a receptacle connector;

a circuit board attached to one of said connectors, said board having at least two coax pads;

one of said plurality of coax contacts has ends that press against said coax pads.

5. A connection apparatus comprising:

a plug and a receptacle;

said plug having a receiver with a cavity open in a predetermined plug mating direction and having a sheath lying within cavity to leave a gap between them extending in a loop completely around said sheath and opening in said plug mating direction, said sheath including an elongated bridge with opposite ends and a coax sheath part that is contiguous with an end of said bridge;

said receptacle including a casing that fits into said gap and that has a casing cavity that receives said sheath, said casing including contiguous bridge-receiving and coax casing parts;

said bridge having a row of plug beam apertures;

a plurality of plug beams contacts mounted on said plug and having beams lying in and projecting from said plug beam apertures;

said casing having a plurality of receptacle beam apertures along said bridge-receiving part, that open to said casing cavity;

a plurality of receptacle beam contacts mounted on said receptacle and having beams lying in and projecting from said receptacle beam apertures and engaging said beams of said plug beam contacts;

said coax sheath part and said casing coax part each includes a coax hole;

first and said coaxial connectors mounted respectively in said coax sheath part and in said second coax casing part and mated to each other.

* * * * *